US010265567B2

(12) United States Patent
Wilt

(10) Patent No.: US 10,265,567 B2
(45) Date of Patent: Apr. 23, 2019

(54) RECIPROCATING, DUAL DIRECTIONAL, NEGATIVE RESISTANCE, EXERCISE MACHINE

(71) Applicant: William B. Wilt, Rock Hill, SC (US)

(72) Inventor: William B. Wilt, Rock Hill, SC (US)

( * ) Notice: Subject to any disclaimer, the term of this patent is extended or adjusted under 35 U.S.C. 154(b) by 0 days.

(21) Appl. No.: 14/880,205

(22) Filed: Oct. 10, 2015

(65) Prior Publication Data

US 2017/0100628 A1 Apr. 13, 2017

(51) Int. Cl.

| | |
|---|---|
| ***A63B 21/00*** | (2006.01) |
| ***A63B 23/02*** | (2006.01) |
| ***A63B 23/12*** | (2006.01) |
| ***A63B 24/00*** | (2006.01) |
| ***A63B 71/06*** | (2006.01) |
| ***A63B 21/005*** | (2006.01) |
| ***A63B 23/035*** | (2006.01) |

(52) U.S. Cl.

CPC ..... *A63B 21/4035* (2015.10); *A63B 21/0058* (2013.01); *A63B 21/15* (2013.01); *A63B 21/4047* (2015.10); *A63B 21/4049* (2015.10); *A63B 23/0233* (2013.01); *A63B 23/03533* (2013.01); *A63B 23/1209* (2013.01); *A63B 23/1281* (2013.01); *A63B 24/0087* (2013.01); *A63B 71/0622* (2013.01); *A63B 2071/065* (2013.01); *A63B 2208/0261* (2013.01); *A63B 2220/51* (2013.01); *A63B 2225/09* (2013.01)

(58) Field of Classification Search

CPC ... A63B 21/002; A63B 21/0023; A63B 23/02; A63B 23/12–23/1209; A63B 23/1227–23/1236; A63B 21/4033; A63B 21/4035; A63B 21/0058

See application file for complete search history.

(56) References Cited

U.S. PATENT DOCUMENTS

| | | | | |
|---|---|---|---|---|
| 4,099,713 A * | 7/1978 | Spector | ..... | A63B 71/0686 340/323 R |
| 4,930,770 A | 1/1990 | Baker | | |
| 4,919,418 A | 4/1990 | Miller | | |
| 5,344,374 A | 9/1994 | Telle | | |
| 5,407,405 A | 4/1995 | Oren | | |

(Continued)

FOREIGN PATENT DOCUMENTS

DE 3532444 3/1987

OTHER PUBLICATIONS

EXERFBOTICS LLC, exerbotics.com website discloding Chest Press/Row Machine.

*Primary Examiner* — Jennifer M Deichl

(74) *Attorney, Agent, or Firm* — Jeffrey Watson; Mathew L. Grell; Grell & Watson Patent Attorneys LLC

(57) ABSTRACT

An exercise machine having band grips mounted on arms that reciprocate at a pre-set incrementally increasing rate of reciprocation and at an applied force capacity greater than a resistive force applied by the user. The band grips are universally mounted for manipulation by the user for repositioning the hands at the beginning of each stroke of reciprocation without removing the hands from the grips, thereby exercising alternate opposing it is. muscle groups during alternate strokes of reciprocation and allowing the user to apply a desired resistive force, which force is measured and displayed for viewing by the user during exercise.

10 Claims, 16 Drawing Sheets

(56) References Cited

U.S. PATENT DOCUMENTS

| | | | | |
|---|---|---|---|---|
| 5,971,895 | A * | 10/1999 | Habing | A63B 21/154 482/100 |
| 6,019,740 | A | 2/2000 | Hausman | |
| 6,244,999 | B1 * | 6/2001 | Alessandri | A63B 23/035 482/108 |
| D445,851 | S | 7/2001 | Diakonov | |
| D520,575 | S | 5/2006 | Diakonov | |
| 7,094,186 | B2 | 8/2006 | Diakonov | |
| D535,336 | S | 1/2007 | Diakonov | |
| 7,563,214 | B2 * | 7/2009 | Webber | A63B 21/155 482/100 |
| 7,578,774 | B1 | 8/2009 | Zetterberg | |
| 8,075,459 | B2 * | 12/2011 | Axelsson | A63B 23/1281 482/100 |
| 2004/0082448 | A1 | 4/2004 | Litman | |
| 2010/0216600 | A1 * | 8/2010 | Noffsinger | A63B 23/12 482/5 |

* cited by examiner

RECIPROCATING, DUAL DIRECTIONAL, NEGATIVE RESISTANCE, EXERCISE MACHINE

Claim is made to the filing date of Oct. 11, 2014 of U.S. Provisional Patent Application Ser. No. 62/062,852 for all subject matter disclosed and claimed in the present application that is disclosed in said Provisional Patent Application.

The present invention relates to exercise machines, and more particularly to exercise machines that provide reciprocating, dual-directional, negative resistance, movement for sequential alternate exercise of opposing muscle groups for enhanced results in exercising the arms, chest, and back of the user.

BACKGROUND OF THE INVENTION

Many machines for exercising arms, chests, and backs of users have been developed in recent years. For example, German Patent No. DE 3532444, issued Mar. 19, 1987, discloses an exercise machine having pivotally swinging training arms that reciprocate through active and passive movements with a maximum force capacity greater than the force that can be imparted by the user. It includes a recording device that detects and displays the angle-dependent force exerted by the user.

Exerbotics, LLC has developed a chest press/row machine, as advertised on its exerbotics.com website, having reciprocating pivoted arms that can be selectively powered for either pulling or pushing, and includes means for detecting and displaying the amount of pressure being exerted by the user.

U.S. Pat. No. 7,578,774, issued Aug. 25, 2009, discloses an exercise machine adding a bar that reciprocates vertically op and down, and is powered by a motor to reciprocate at a constant rate, with the capacity of force being applied by the motor being greater titan the press or pull of the user.

Other examples of exercise machines having a drive mechanism driven at a constant rate regardless of the resistive force applied by the user are disclosed in U.S. Pat. No. 6,019,740, issued Feb. 1, 2000, U.S. Pat. No. 4,930,770, issued Jan. 5, 1990, and U.S. Pat. No. 4,919,418, issued Apr. 24, 1990.

None of these prior art disclosures have pivotable hand gaps that allow repositioning of the hands of the user, without releasing the handle, from a position for pushing against movement of exercise arms toward the user to exercise a particular set of muscles and a reversed position of the hands for pulling against movement of exercise arms away from the user to exercise a different set of muscles. Universally pivotable hand grips are disclosed in the prior an, such as in U.S. Pat. No. 5,344,374, issued Sep. 6, 1994, U.S. Pat. No. 5,407,405, issued Apr. 18, 1995, and U.S. Patent Publication No. 2004/0082448, published Apr. 29, 2004. However, none of these universally pivotable hand grip disclosures are for the purpose of alternately positioning the hands of the user for applying resistance to an exercise arm moving toward the user for exercising one set of muscles and positioning the hands of the user for applying resistance to an exercise arm moving away from the user for exercising a different set of muscles.

Further, there is no known disclosure in the prior art of controlling the rate of reciprocation of said arms during a set of reciprocations in a pattern, selected by the user, of incrementally increasing rates of reciprocation during sequential repetitions of a set of repetitions to simulate the fatigue factor occurring when a user is exercising with free weights.

SUMMARY OF THE INVENTION

The exercise machine of the present invention has reciprocating arms mounted on a frame for exercising the arms, chest, and back of the user and has pivotally mounted hand grips on the arms that allow repositioning of the hands of a user without having to release and regrasp the grips when the arms reciprocate in alternate strokes of reciprocation for exercise of alternate opposing muscle groups during alternate strokes, such as exercising the pectoralis major muscles of the user during one direction of reciprocation of said arms and exercising the latissimus dorsi muscles of the user during the opposite direction of reciprocation of said arms.

The hand grips are preferably universally pivotable for free positioning of the hands m any comfortable position during exercise, as well as for repositioning when the arms reciprocate.

In the preferred embodiment, the arms have inner portions pivotally attached to the frame and driven by an actuator to cause the inner portions to reciprocate toward and away from each other, and outer portions pivotally attached to the outer ends of the inner portions, with the hand grips being attached to the outer portions. The pivotal attachment of the inner portions to the frame correspond s generally to the shoulders of the user. The pivotal attachment of the outer portions of the inner portions is at a location generally corresponding to the elbows of a user. The hand grips are disposed generally at the location of the hands and wrists of the user. With tins arrangement the movement of the articulated arms simulate the pivoted flexing movement of the arms of the user, and the arms can accommodate therebetween different users having different shoulder widths and stroke lengths. The pivoted connection of the outer arm allows a user to simulate close grip, wide grip, and reverse grip hand positioning, and can simulate pectoral flyes.

The arms are reciprocated by the actuator that applies a force to move the arms with an applied capacity greater than the resistive force applied by the user. The resistive force applied by the user is measured by a load cell and displayed by a computer processing unit for observation by the user.

The computer processing unit is mounted on the frame and is operatively connected to the actuator to control reciprocation of the arms as selected by the user to provide a desired intensity of exercise in a pattern, selected by the user, of incrementally increasing rates of reciprocation during sequential repetitions of a set of repetitions to simulate the fatigue factor of exercising with free weights. In one embodiment the computer processing unit provides three patterns for selection by the user. One pattern provides relatively slow rates of reciprocation for relatively long application of resistive force for endurance exercising. A second pattern provides relative fast rates of reciprocation for relatively short application of resistive force for strength exercising. A third pattern provides intermediate rates of reciprocation for intermediate application of resistive force for muscle size exercising.

In a preferred embodiment, the body support mounted on the frame is inclined and concavely curved for supporting the back of a user in an inclined concave position for optimum positioning of the user for exercising on the machine.

In another embodiment of the present invention an armrest is mounted on a frame for supporting the elbows and adjacent portions of the upper arms of a user. The machine has an arm mounted on the frame in general alignment with die intended position of the elbows of the unit. Universally pivoted handgrips, which are the same as the hand grips of the first embodiment, are attached in spaced relation on the ends of a cross bar mounted on the outer end of the pivoted arm. An actuator controlled by a computer processing unit reciprocates the arm at a constant rate of reciprocation at a force greater than the resistive force applied by the user. This embodiment allows relocating the hands of the user for alternate exercise of opposing arm muscles during the alternate strokes of reciprocation.

DETAILED DESCRIPTION OF THE PREFERRED EMBODIMENTS OF THE INVENTION

Figure 1:
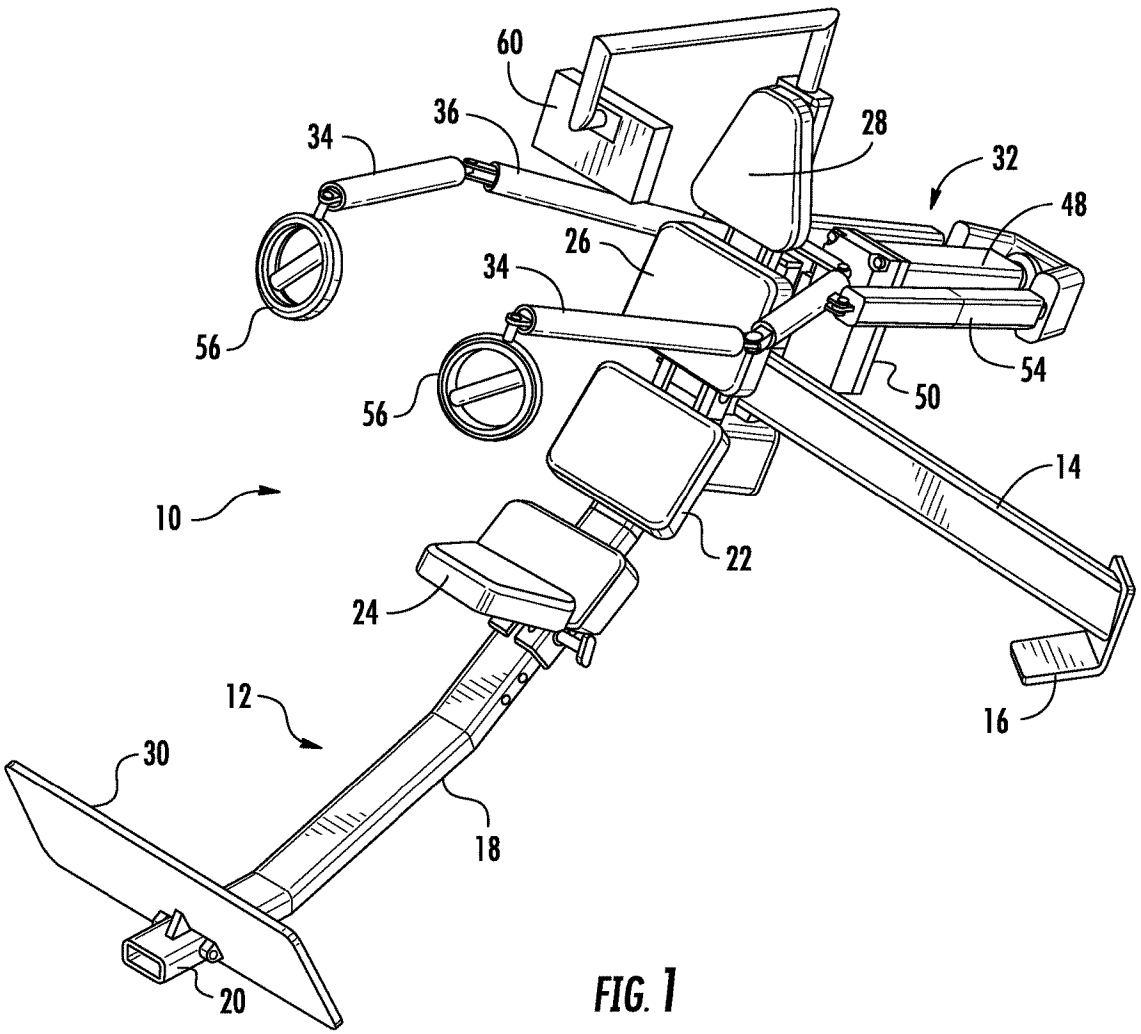
FIG. 1 is a perspective view of the exercise machine of the present invention showing the exercising arms in an extended position.
Figure 2:
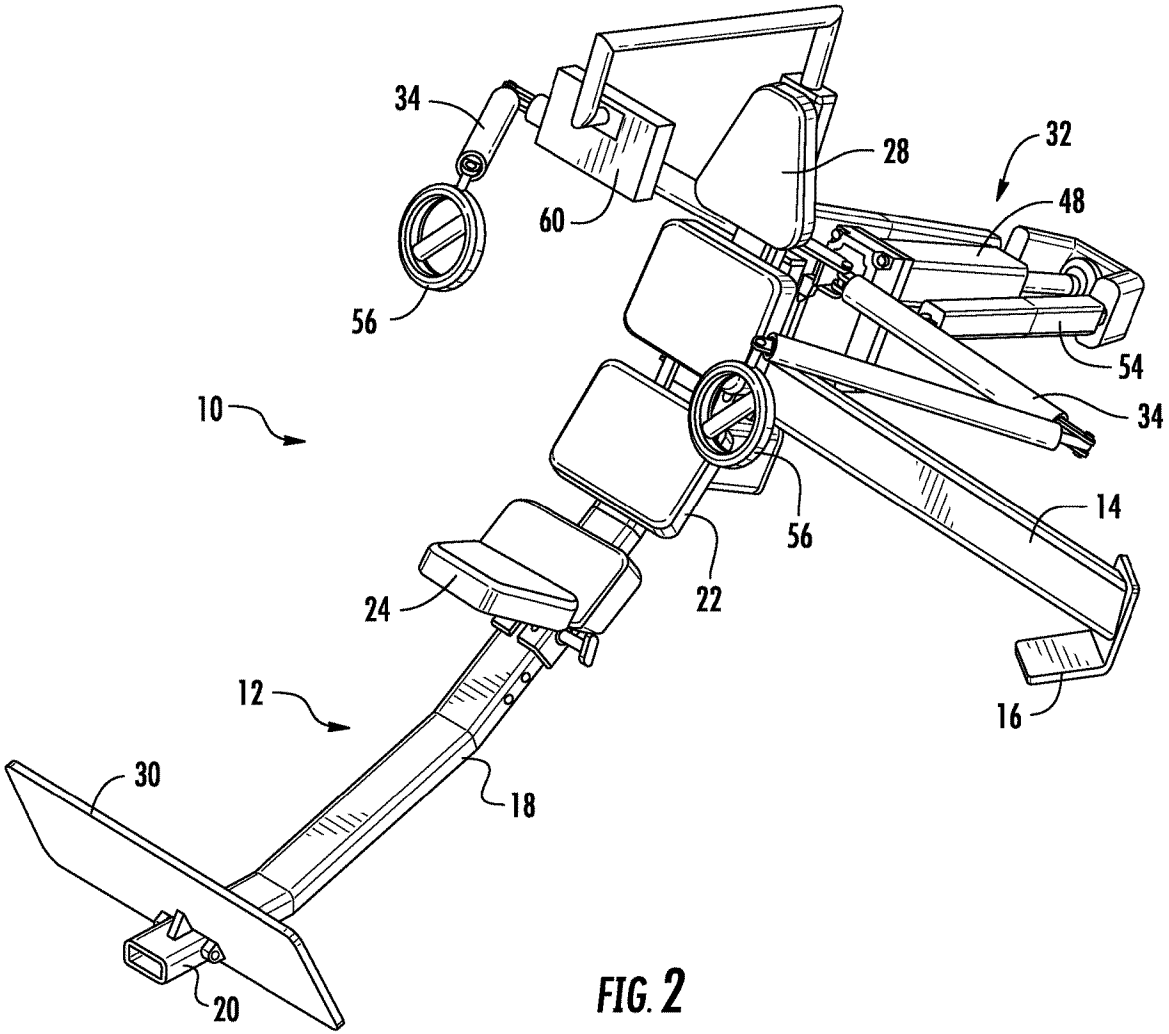
FIG. 2 is a view similar to FIG. 1 showing the exercising arms in a retracted position.
Figure 3:
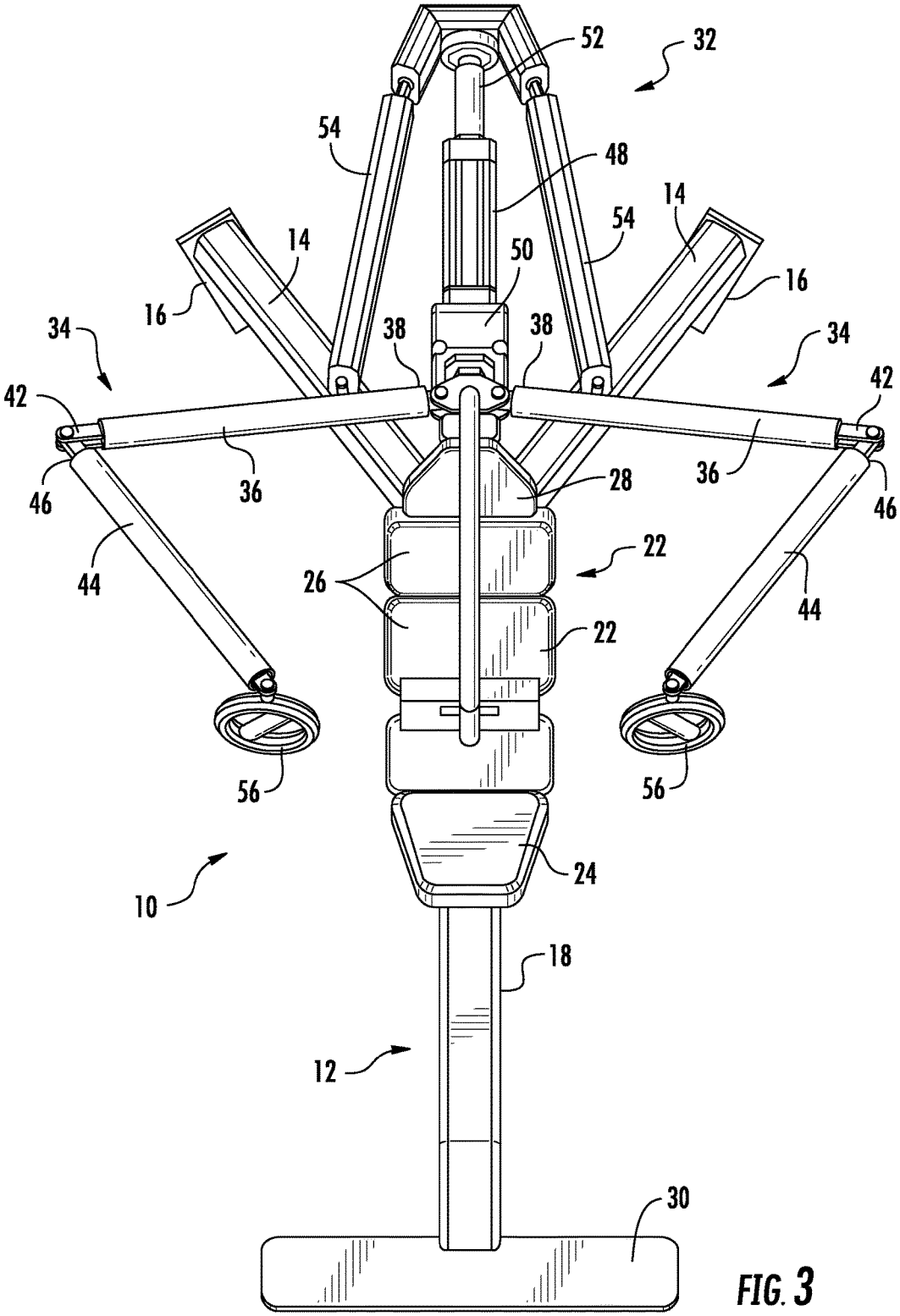
FIG. 3 is a plan view of the exercise machine of FIG. 1.
Figure 4:
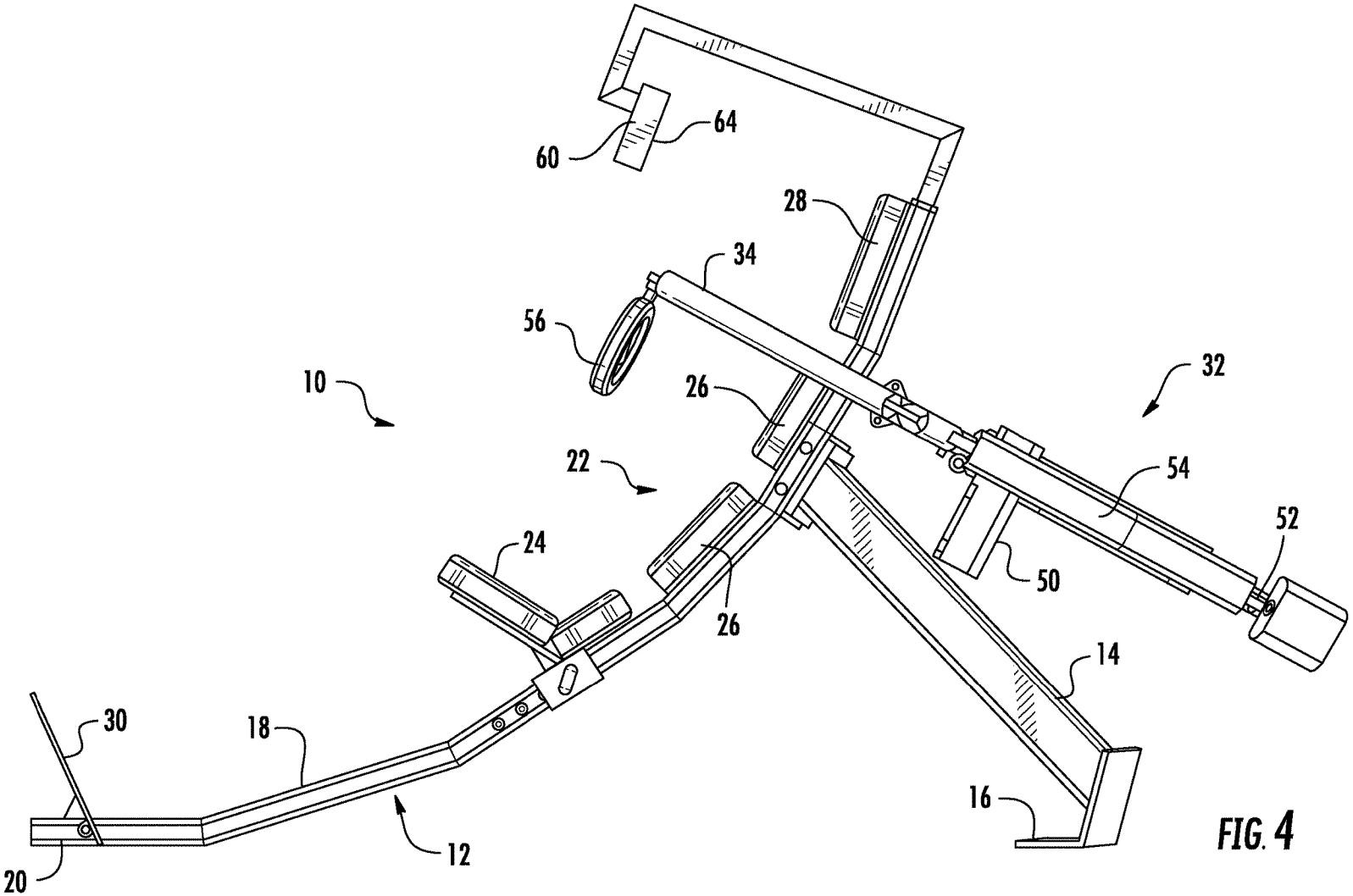
FIG. 4 is a side elevational view of the exercise machine of FIG. 1.

The reciprocating, dual-directional, negative resistance, exercise machine 10 of the preferred embodiment of the present invention is illustrated in FIGS. 1-12. The machine includes a frame 12 having a pair of legs 14 extending outwardly and rearwardly with feet 16 at their outer ends for supporting the machine 10 on a floor. A central leg 1S extends forwardly with a foot 20 at its forward end for resting on the floor. The central leg 1S has a body supporting portion 22 that includes an adjustably positioned seat 24, two spaced back rests 26, and a headrest 28. A foot rest 30 is located on the central leg 18 of the frame 12 adjacent the foot 20 of the central leg 18. The central leg and the body support portion 22 mounted on the central leg are inclined and concavely curved for support of a user in a comfortable position for minimized strain during exercise on the machine 10. Typically, the curvature is of about 40 inches radius through approximately 850.

Figure 6:
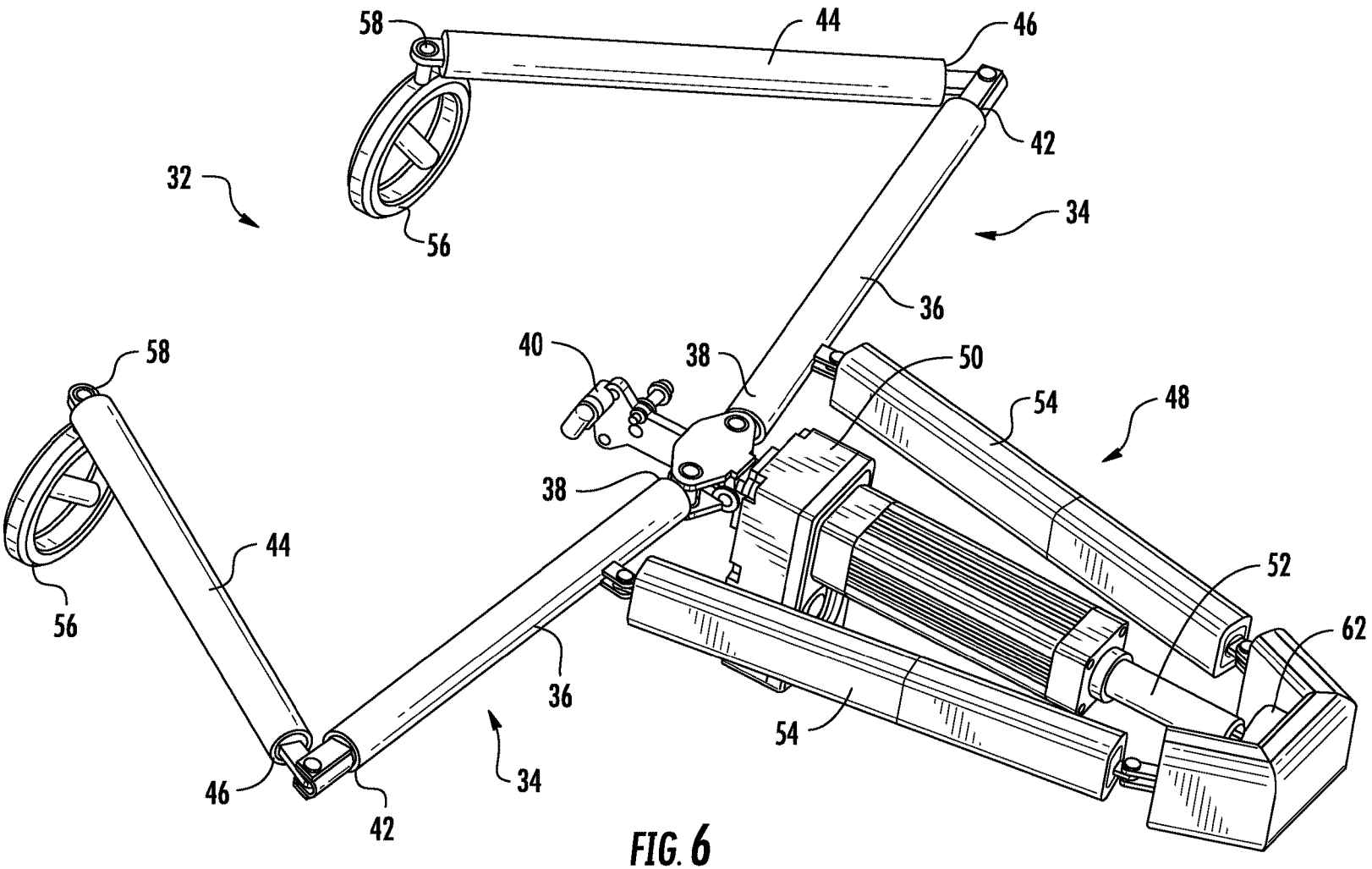
FIG. 6 is an enlarged perspective view of the operating members of the exercise machine of FIG. 1 showing the exercising arms in a retracted position.
Figure 7:
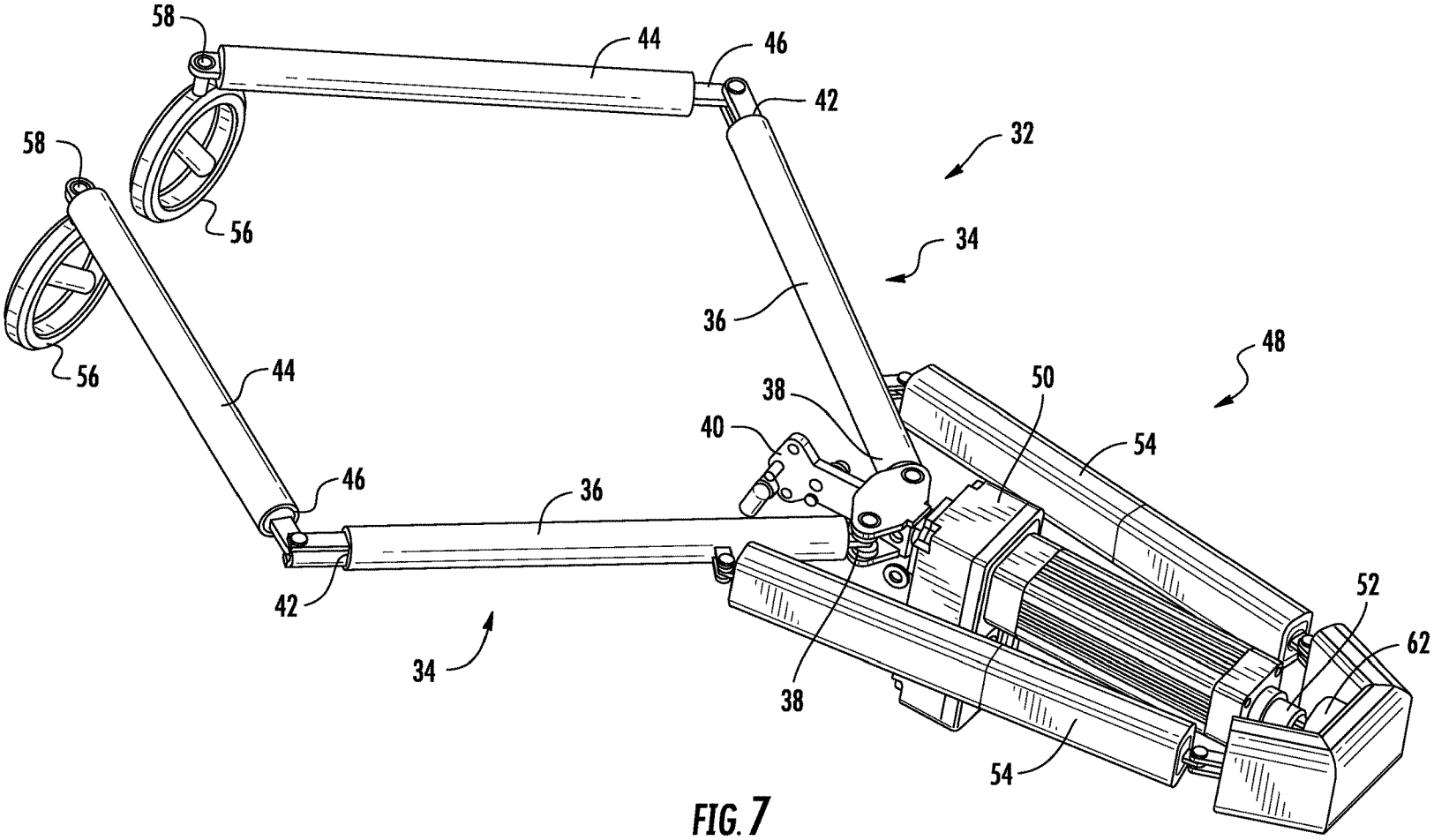
FIG. 7 is a view similar to FIG. 6 showing the exercising arms in an extended position.

Pivotally mounted on the frame 12 is an operating unit 32, best illustrated in FIGS. 6 and 7. The operating unit 32 includes a pair of coplanar operating arms 34 having inner portions 36 that have inner ends 38 pivotally mounted on the frame 12 through a connecting bar 40 for pivoting of the arms toward and away from each other. The inner portions 36 have outer ends 42 spaced outwardly from the inner ends 38. The operating arms 34 have outer portions 44 pivotally attached at their inner ends 46 to the outer ends 42 of the inner portions 36. This arrangement of pivoted inner and outer portions accommodates the use of the machine 10 by users of a range of shapes and sizes.

The operating unit 32 includes an actuator 48 having mounted thereon a continuous dynamic load electric motor 50 that linearly reciprocates a screw piston 52, which is connected by drive rods 54 to the inner portions 36 of the operating arms 34 outwardly of the inner ends 38 of the inner portions 36 to create arcuate reciprocation of the inner portions 36 of the operating arms 34 toward and away from each other, resulting in the outer portions 44 of the operating arms 34 reciprocating away from and toward the frame 12 when extended by a user grasping hand grips 56 pivotally attached at outer ends 58 of the outer portions 44 of the operating arms 34.

The motor 50 is controlled by a conventional computer processing unit 60 to reciprocate the arms at rates of reciprocation selected by the user with a maximum force greater than the force exerted by a user through the hand grips 56 to exercise by attempting to resist movement of the operating arms 34. Thus, the operating arms 34 continue to reciprocate at the selected rate of reciprocation regardless of the resistive force applied by the user.

The pivotable hand grips 56 allow reverse manipulation of hand positions during reversal of reciprocation without having to release and regrasp the grips when the actuator reverses reciprocation of the arms. For example, in one direction of reciprocation the user can exercise his pectoralis major muscles, and in the other direction of reciprocation the user can exercise his latissimus dorsi muscles.

Preferably, the hand grips 56 are universally pivotable to permit free positioning of the hands of the user in comfortable positions at all times during exercise on the machine, as well as facilitating the reversal of hand positions without having to release and regrasp the hand grips when reciprocation is reversed.

Figure 5:
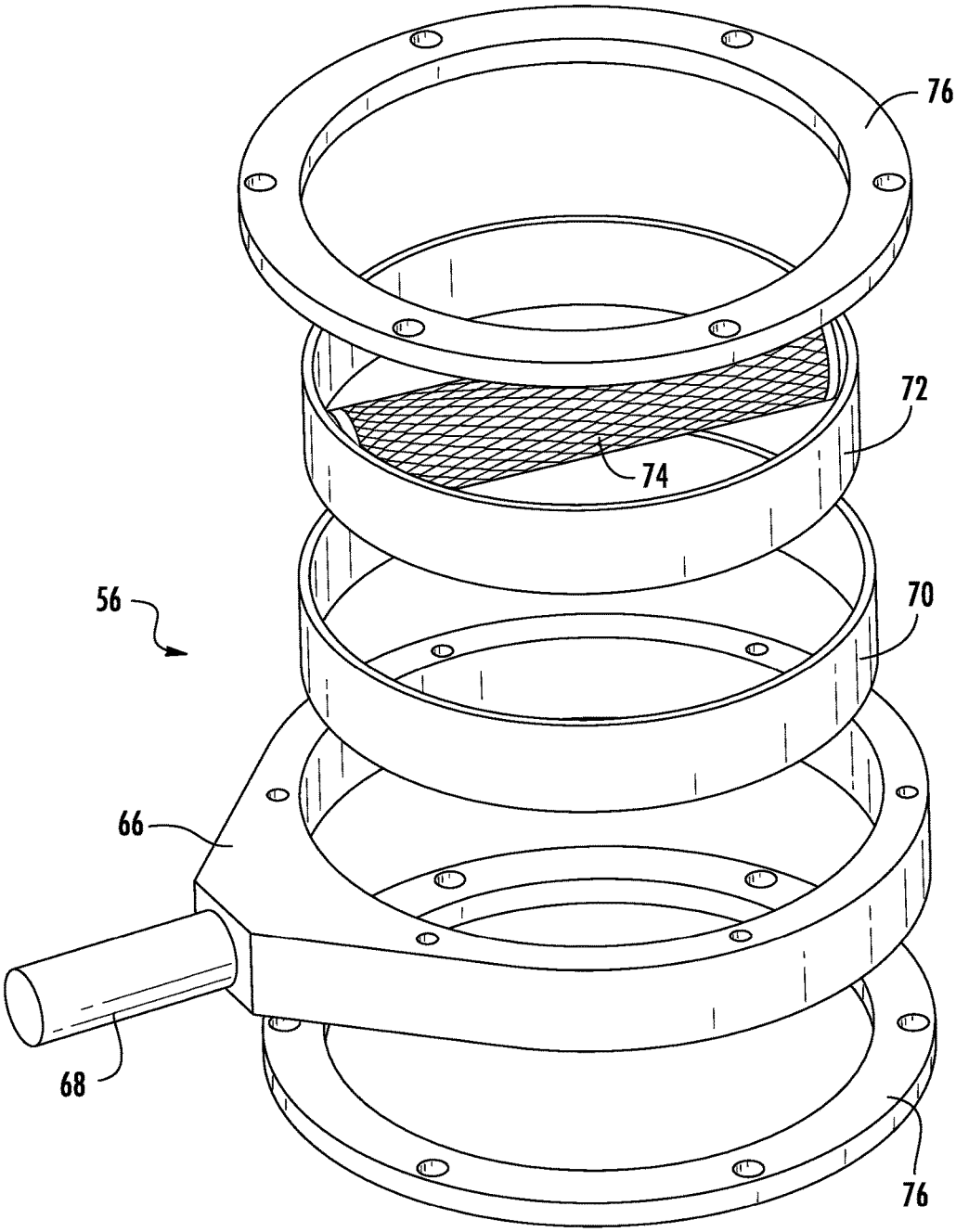
FIG. 5 is an exploded view of one of the universally pivotable hand grips of the exercise machine of FIG. 1.

An exploded view of a universally pivotable hand grip 56 is illustrated in FIG. 5. This hand grip includes an outer ring 66 having a stud 68 projecting radially outward for free rotational attachment in the outer end 58 of the outer portion 44 of an operating arm 34. A circular polycarbonate bushing 70 seats around the interior of the outer ring 66, and an inner ring 72 is seated in the bushing 70 with a diametrically extending handle 74 secured in the entering 72. Circular end discs 76 are secured to the opposite sides of the outer ring 66 and extend inwardly over the bushing 70 and inner ring 72 to fix all the rings in place. With this construction, the handle 74 of the hand grip 56 can be manipulated universally to position and reposition the hands of the user in any desired position, such as a position resisting inward movement of the operating arm 34 and a reverse position resisting outward movement of the operating arm 34.

A load cell 62 is mounted on the actuator 48 for sensing the resistive force being applied by the user. The computer processing unit 60 is connected to the load cell 62 for receiving an indication of the amount of sensed resistive force, which the computer processing unit 60 displays on a display panel 64 positioned for observation by a user during exercise. This allows the user to see, in real time, the force being applied, where in the reciprocation the resistive force is strongest, and where in the reciprocation the resistive force is weakest. Thereby giving the user not only the ability to see what the maximum and minimum reciprocation strengths are, but allows the user to see where, within the reciprocation, improvement is needed.

Figure 9:
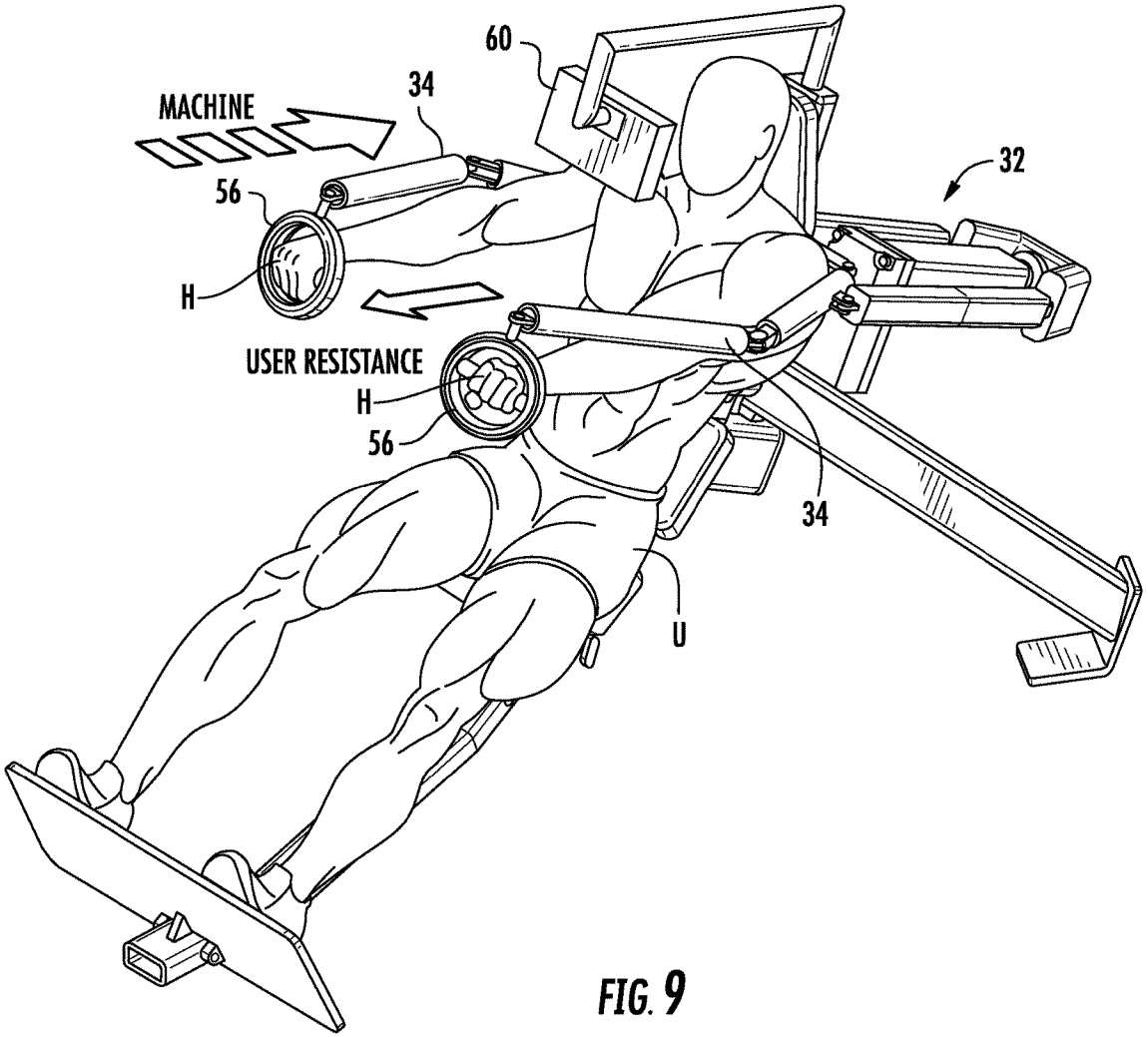
FIGS. 9-12 are illustrations showing a user, including the positioning of the hands of the user, at the beginning and end of each stroke of reciprocation.
Figure 10:
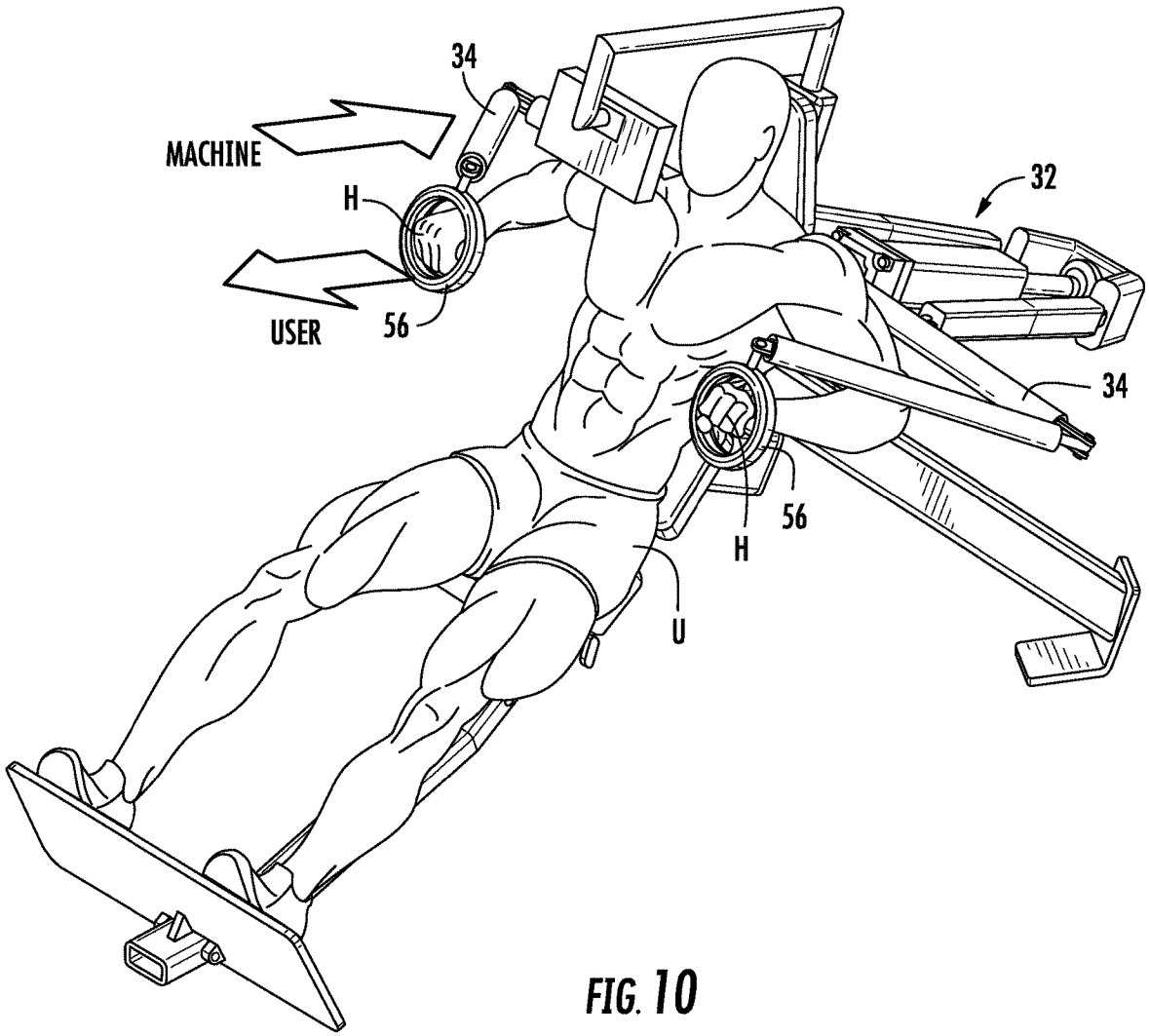
Figure 11:
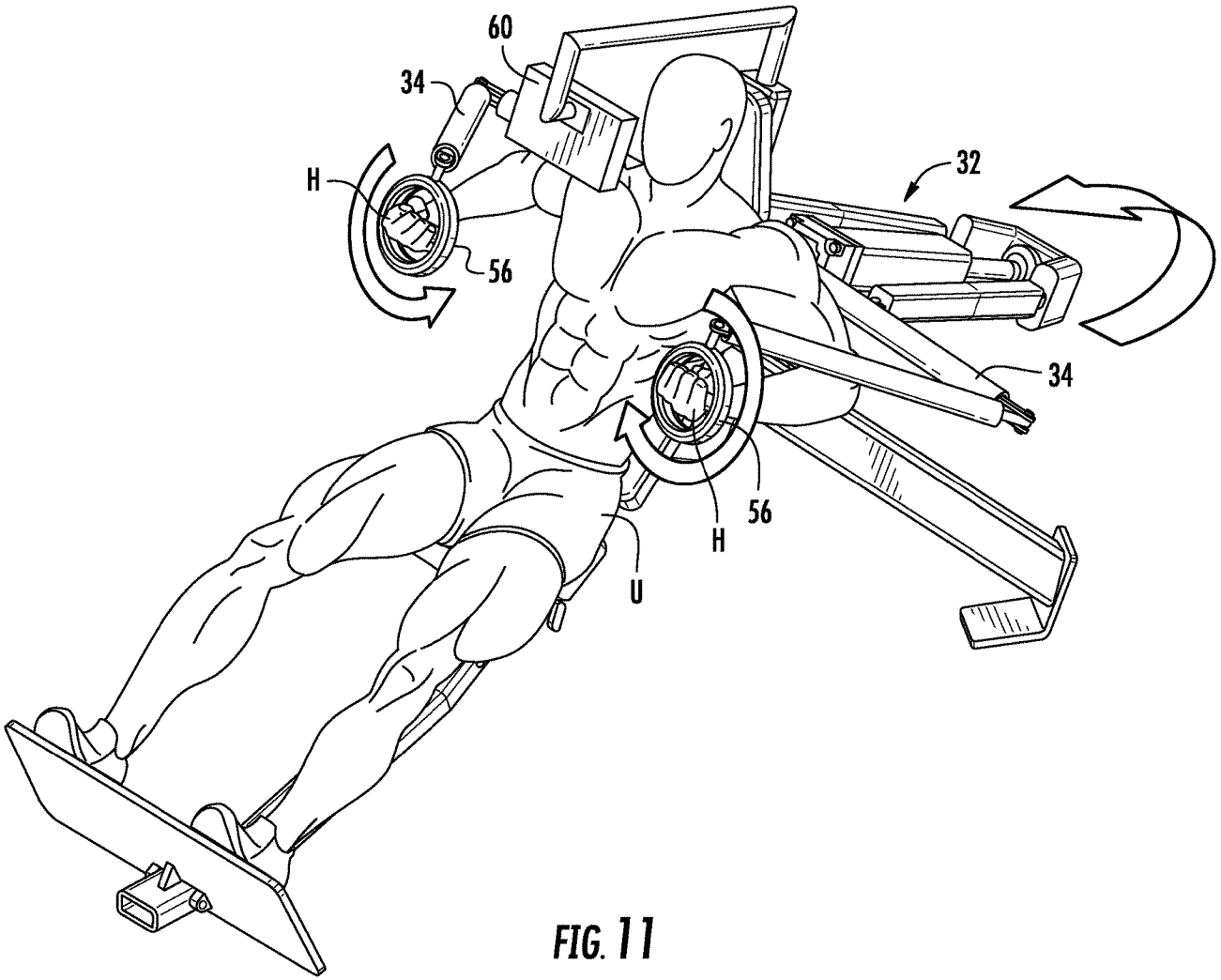
Figure 12:
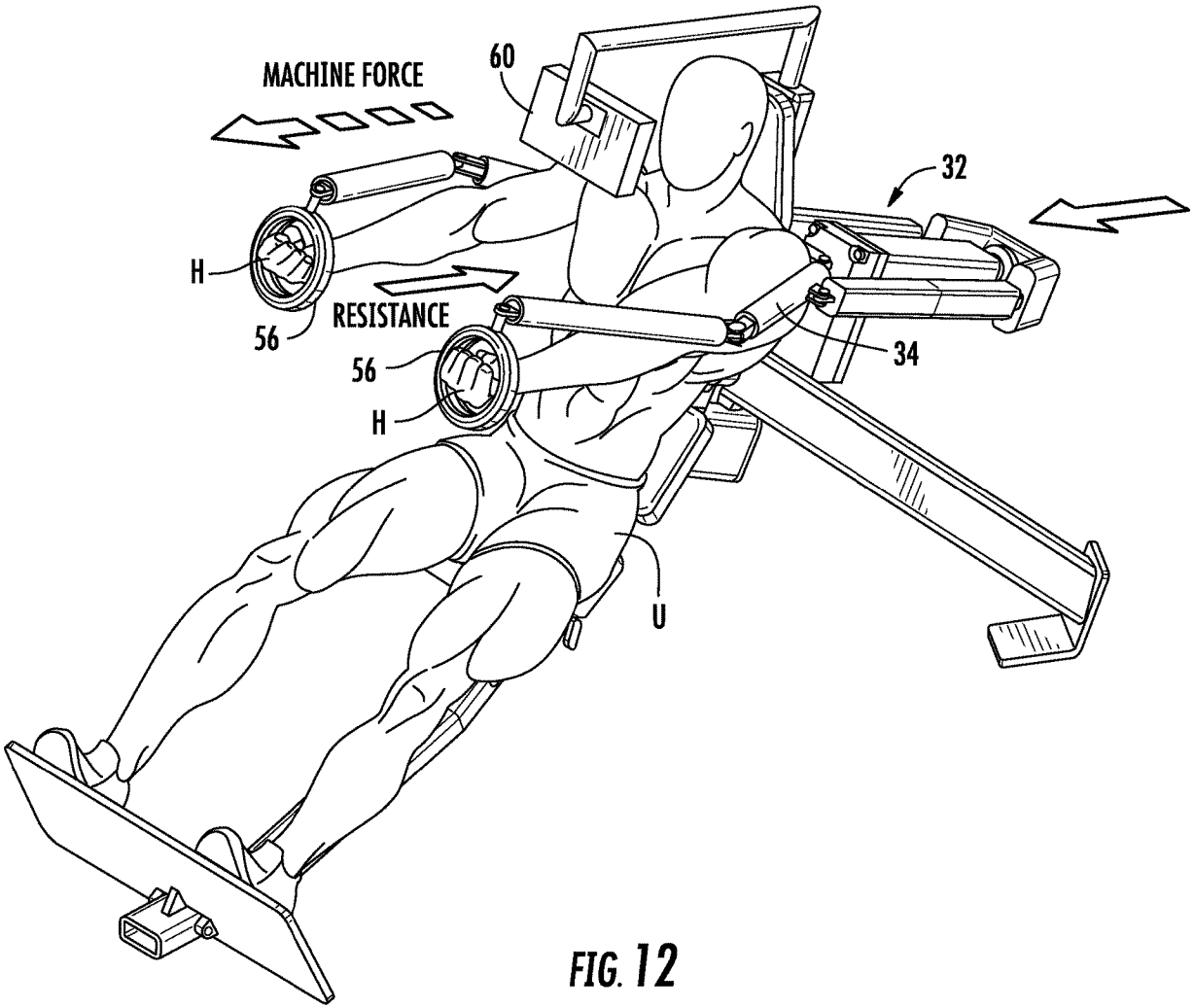

The sequence of reciprocation of the operating anus 34 with a user U applying a resistive force in exercising is illustrated in FIGS. 9-12. FIG. 9 illustrates the user U seated on the body supporting portion 22 with his hands H grasping the handles 74 of the hand grips 56. In this position the operating arms 34 are extended and beginning to be retracted with the user's hands H extending over the handle and the palms facing outwardly against the handle H as the user applies an outward resistive force in opposition to the retraction of the operating arms 34. FIG. 10 illustrates the condition when the operating arms 34 are completing inward movement, with the users hands in the same position as illustrated in FIG. 9. FIG. 11 illustrates the user in the same position as in FIG. 10, but with the hands H reversed in the hand grips 56 with the palms extending under the handles 74 and upwardly on the outer side of the handles with the fingers and palms applying an inwardly pulling resistive force against outward movement of the operating arms 34. FIG. 12 illustrates the condition the operating arms 34 are approaching completion of their outward movement, with the hands in the same position as illustrated in FIG. 11.

The computer processing unit 60 controls the rate of reciprocation of the operating anus 34 during a set of reciprocations in a pattern, selected by the user, of incrementally increasing rates of reciprocation during sequential repetitions of a set of repetitions. Preferably, the computer processing unit is programmed for selection by the user of a desired one of a plurality of patterns having different sequentially increasing rates of reciprocation of the operating arms 34. In a representative embodiment the plurality of patterns includes three patterns. One pattern provides incrementally increasing relatively slow rates of reciprocation, resulting in relatively long periods of time for relatively long application of resistive force during each incrementally decreasing length of reciprocation, which provides endurance exercising. A second pattern provides incrementally increasing relatively faster rates of reciprocation, resulting in relatively short periods of time for each relatively short application of resistive force during each incrementally decreasing time of reciprocation, which provides strength exercising. A third pattern provides incrementally increasing intermediate rates of reciprocation, resulting in relatively intermediate length periods of time for relatively intermediate length periods of application of resistive force during each incrementally decreasing time of reciprocation, which provides muscle size exercising, from stimulation of sarcoplasmic fluid expansion.

A specific example of three patterns to give the user a different experience and work towards different goals are:

1) MAX ENDURANCE and NEURAL-MUSCULAR REHAB: 10 repetitions in each direction per set as: 10 seconds, 10 seconds, 9 seconds, 8 seconds, 7 seconds, 6 seconds, 5 seconds, 4 seconds, 3 seconds, 2 seconds for a total time under tension of 64 seconds in each direction, alternately 64 seconds for chest exercise and 64 seconds for upper back exercise. This exercise increases muscular endurance in response to glycogen depletion, enhancing the efficiency of ATP re-uptake/use.

2): MAX SIZE; 8 repetitions in each direction per set as: 9 seconds, 8 seconds, 7 seconds, 6 seconds, 5 seconds, 4 seconds, 3 seconds, and 2 seconds for a of total time under tension of 44 seconds in each direction, alternately 44 seconds for chest exercise and 44 seconds for upper back exercise. This increases muscle size caused by sarcoplasmic fluid expansion.

3) MAX STRENGTH: 5 repetitions in each direction per set as: 6 seconds, 5 seconds, 4 seconds, 3 seconds, and 2 seconds for a total time under tension of 20 seconds in each direction. This pattern increases strength caused by Myofibrillar Hypertrophy, also known as fiber splitting.

In these patterns, each set incrementally diminishes in time, simulating the feel of free weight exercise. In free weight exercise, the user at first has no problem lowering the weight at a controlled pace, but as a set continues, the weight will seem to get heavier with each repetition, due to fatigue. The user will be losing control of how slow the user can lower the weight, struggling until the user reaches a point where the user can no longer control the rate of descent. This effect is avoided with the machine of the present invention by decreasing the time for each repetition in each pattern, giving the user at first the feeling of slowing the machine down, which of course the user is not, and as the reciprocations increase in rate the user will have the psychological motivation to continue applying resistance, rather than succumbing to failure because of fatigue.

Figure 8B:
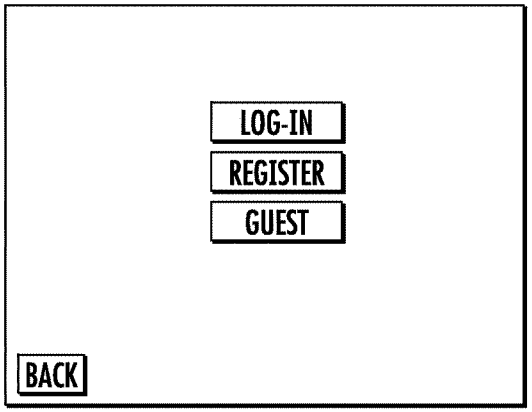
FIGS. 8A-8H are schematic views of a sequence of displays on a display screen of the exercise machine of FIG. 1.
Figure 8D:
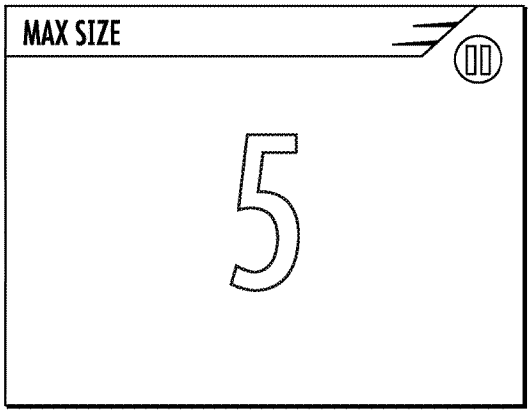
Figure 8A:
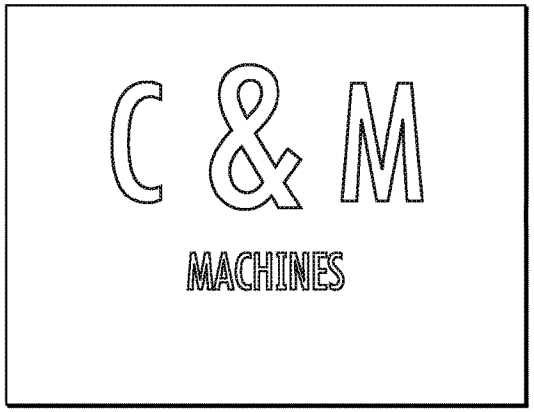
Figure 8C:
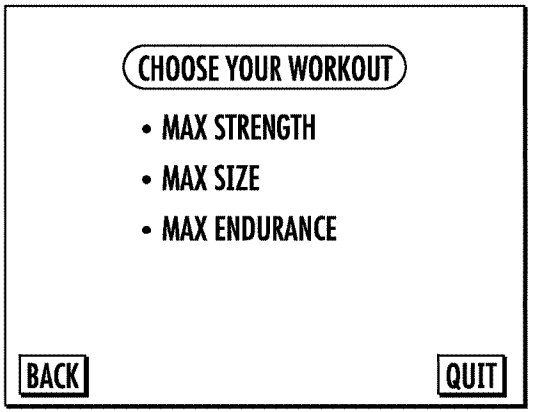
Figure 8F:
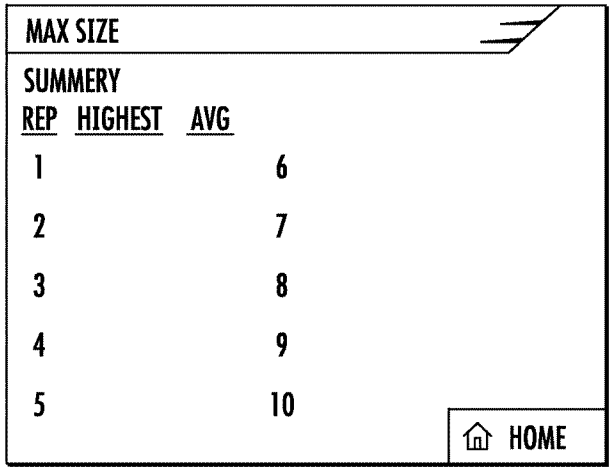
Figure 8E:
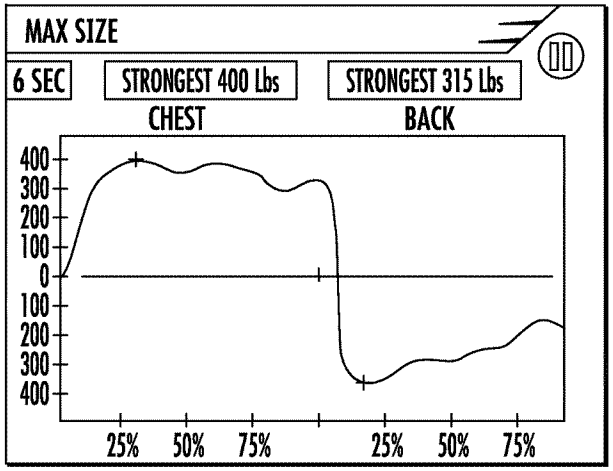
Figure 8H:
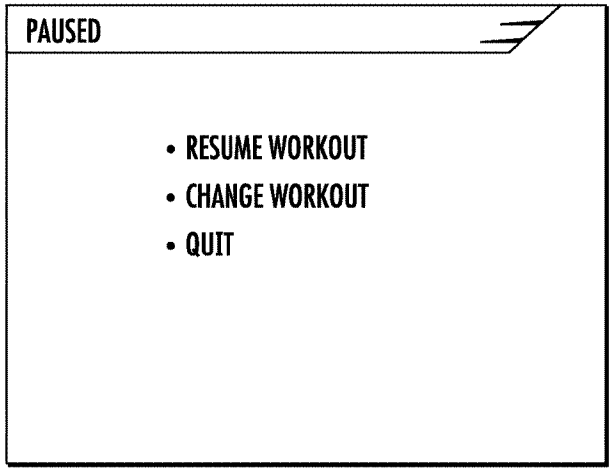
Figure 8G:
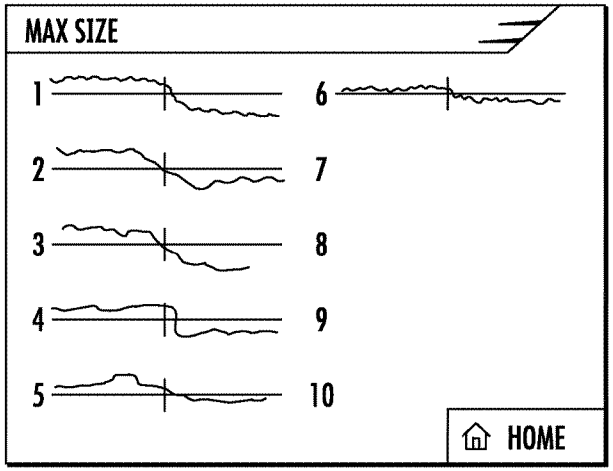

A typical sequence of screens displayed on the display panel 64 is illustrated in FIGS. 8A through 8H. FIG. 8A shows the opening screen identifying the machine manufacture. FIG. 8B shows the registering screen. FIG. 8C shows three patterns from, which the user selects the pattern to be used in an exercise. FIG. 8D shows the countdown seconds before the set begins. FIG. 8E displays a graph in real time of the resistive force being applied, which information the user uses to determine whether the user needs to adjust the resistive force being applied. FIG. 8F displays a chart showing the highest and average resistive force applied during repetition. FIG. 8G displays graphs of the duration of resistive force applied by a user during each reciprocation of a set of 10 repetitions. FIG. 8H displays a pause screen indicating that the exercise has been paused and providing the user with an opportunity to resume the workout, if it had not been completed, change the workout, or quit.

Figure 13:
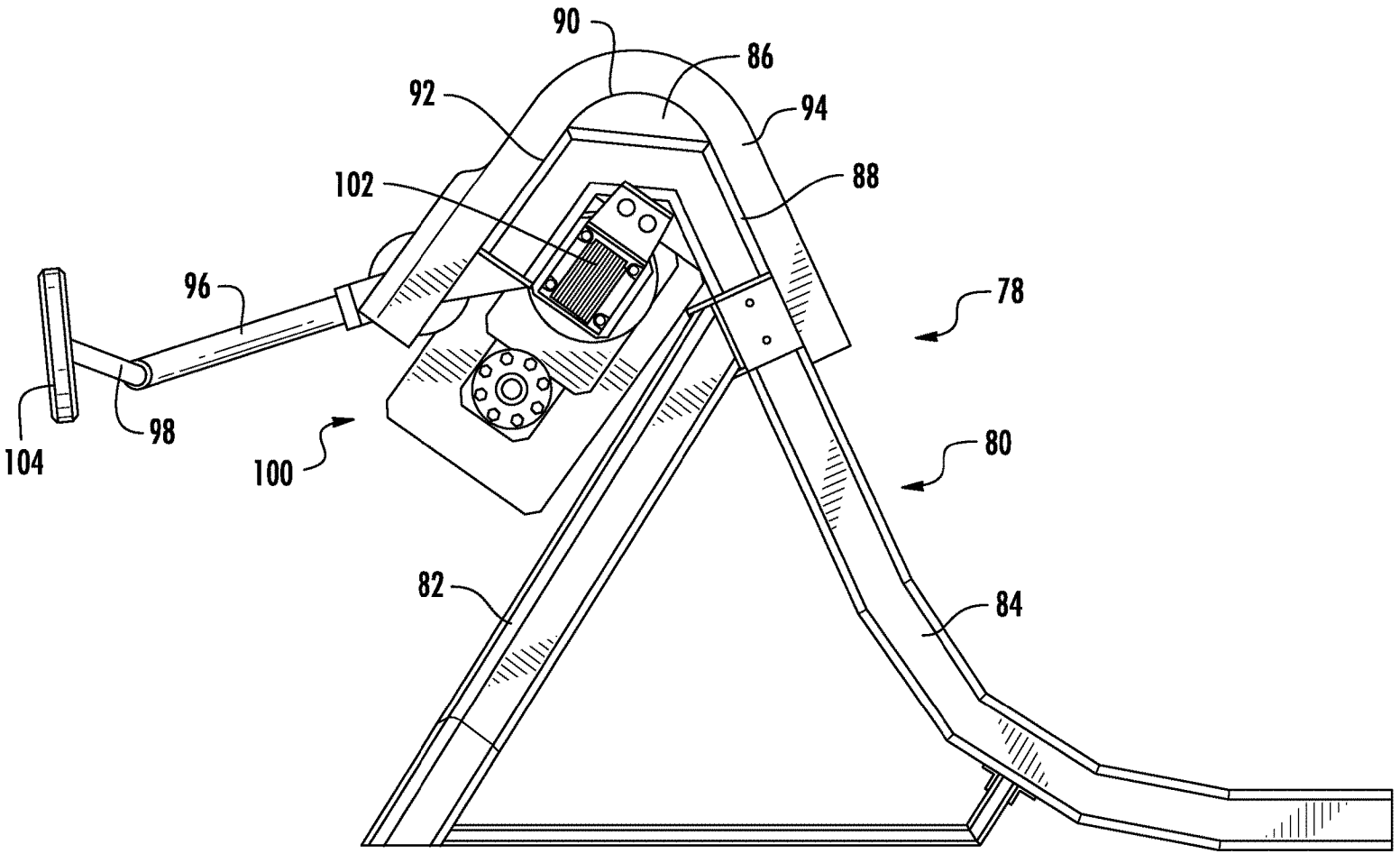
FIG. 13 is a side elevation view of an exercise machine of another embodiment of the present invention.
Figure 14:
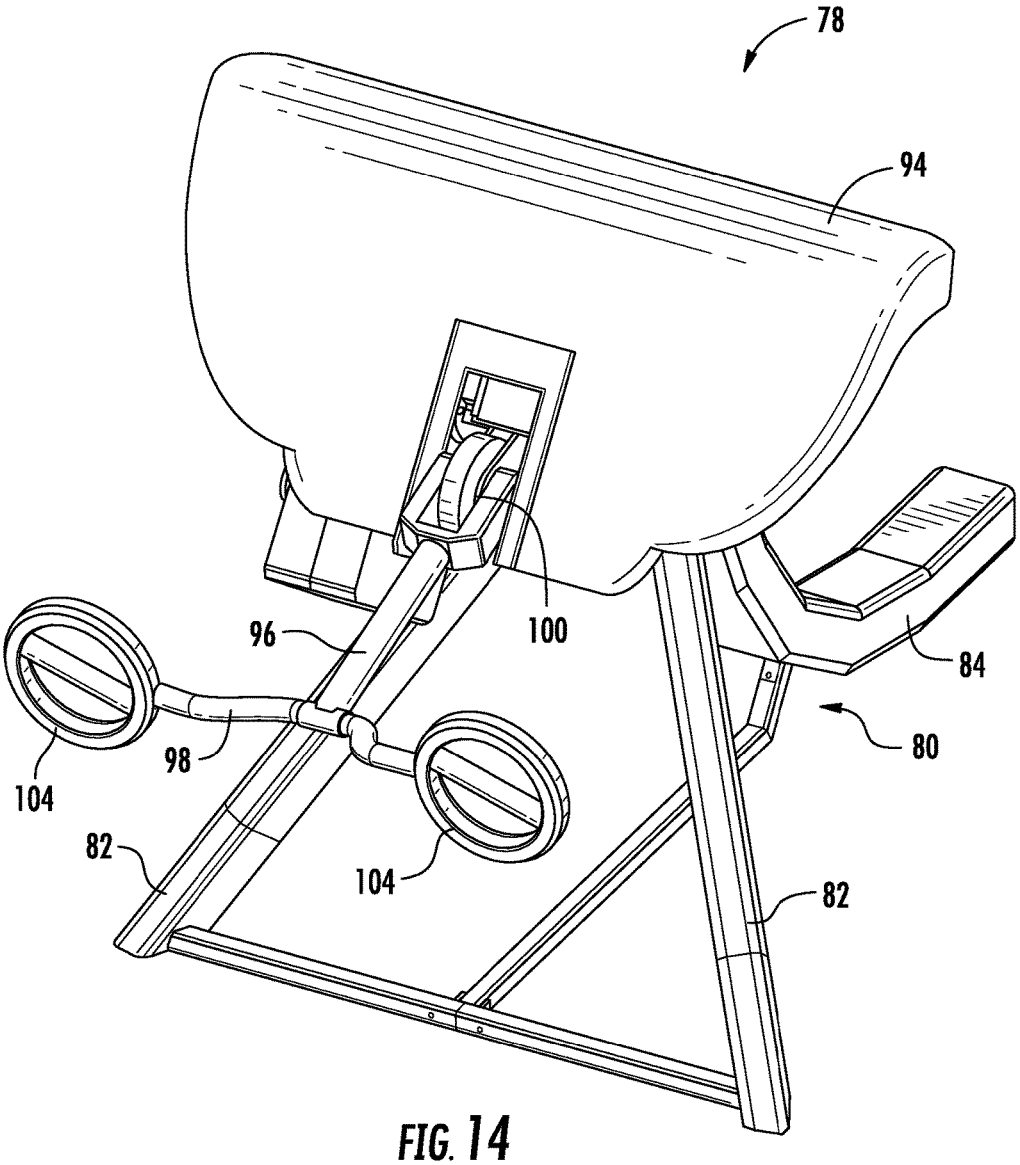
FIG. 14 is a perspective view of the exercise machine of FIG. 13.
Figure 15:
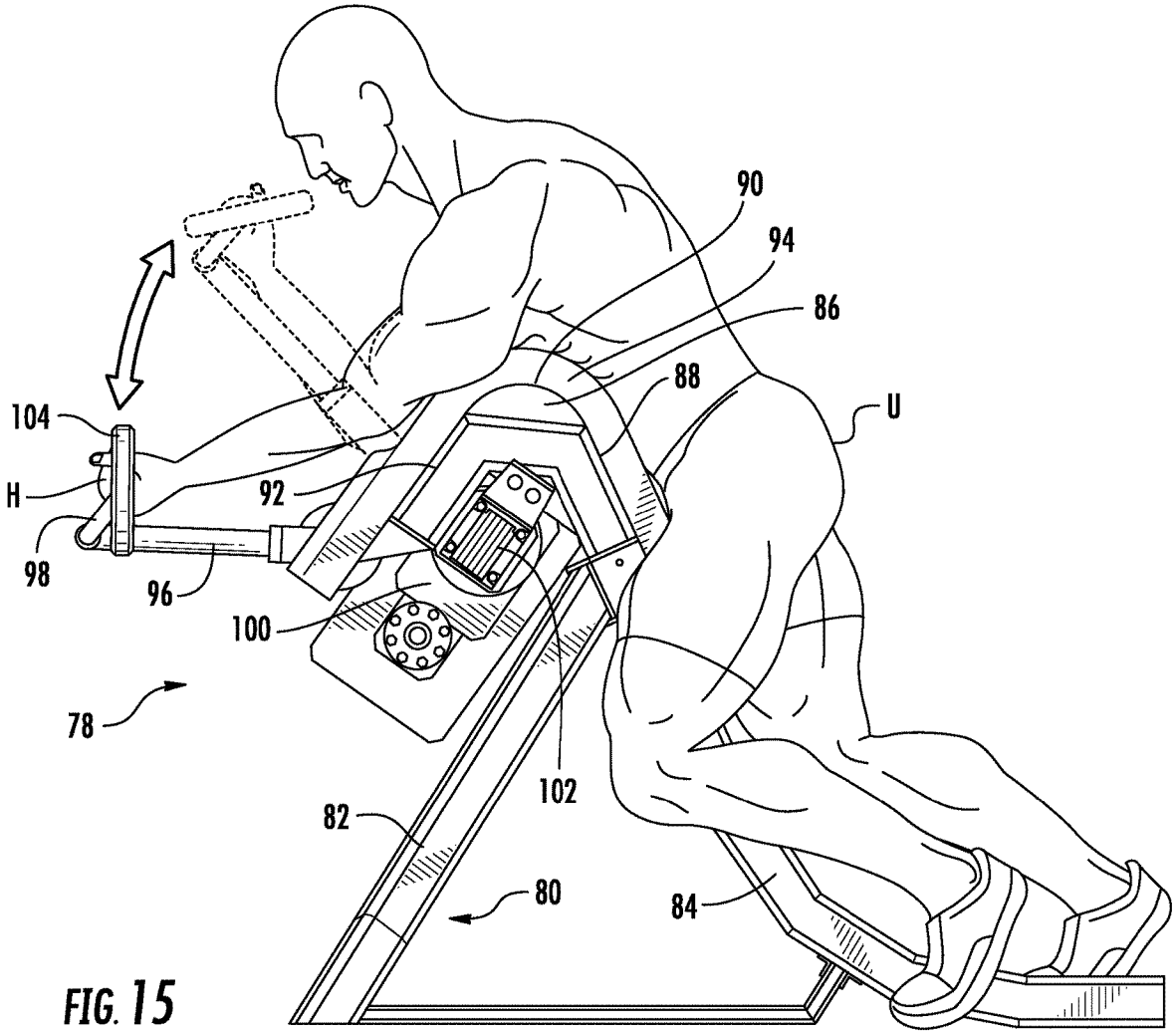
FIG. 15 is a view similar to FIG. 13 including a sketch of a user in an exercising position on the exercise machine.

Another embodiment of the exercise machine of the present invention is illustrated in FIGS. 13-15. The exercise machine 78 of this embodiment includes a frame 80 having two front legs 82 and one rear leg 84 that support a top portion 86 that has a rear surface 88 inclined upwardly and forwardly, a convex top surface 90 and a front surface 92 extending downwardly and forwardly. These surfaces are covered with a layer of padding 94 for support of a user (see FIG. 15) with his body against the rear surface 88 and his arms resting on the front surface 92. A reciprocating operating arm 96 is pivotally attached to the frame 80 in approximate alignment with the elbows of the user. A drive system 100, including an electric drive motor 102, is mounted under the top portion 86 of the frame 80 and is drivingly connected to the operating arm 96 for drivingly reciprocating the operating arm 96 to exercise the arms of a user.

At the opposite ends of the crossbar 98 hand grips 104 are mounted. These hand grips 104 are identical to the hand grips 56 of the embodiment of FIGS. 1-12, described above, and have the same unique advantageous purpose and function.

In view of the foregoing written description of the present invention, it will be readily understood by those skilled in the art that the present invention is susceptible of broad utility and application in many embodiments and adaptations other than those herein described without departing from the substance or scope of the present invention. Accordingly, while the present invention has been described herein in detail in relation to preferred embodiments, it is to be understood that the disclosure is only illustrative examples of the present invention and is made merely for purposes of providing a full and enabling disclosure of the invention, the present invention being limited only by the scope of the claims appended hereto and equivalents thereof.

What is claimed is:

1. A reciprocating, dual-directional, negative resistance, exercise machine, comprising:

a frame having a body support portion for supporting the body of a user, said body support portion is inclined and concavely curved for supporting the back of a user in an inclined concave position;

an operating unit pivotally mounted between a back rest and a head rest positioned on the body support portion of the frame via a connecting bar, the operating unit including:

a pair of coplanar operating arms, said arms having inner portions pivotally mounted at inner ends on said frame through a connecting bar for pivoting of the arms toward and away from each other, said inner portions having outer ends spaced outwardly from said inner ends, said arms being spaced from each other to accommodate therebetween a user supported on said body support portion, said arms having outer portions pivotally attached to said outer ends of said inner portions;

an actuator mounted on said frame with an electric motor that is configured to linearly reciprocate a screw piston, the screw piston is operatively connected to said inner portions of said arms via drive rods that connect the linearly reciprocating screw piston to each of the inner portions of the coplanar operating arms to cause reciprocation of said inner portions toward and away from each other at selected rates of reciprocation with a maximum force applying capacity greater than a force exerted by a user in attempting to resist movement of said arms;

wherein, the pair of coplanar operating arms, linearly reciprocating screw piston and drive rods are aligned through the mounted position of the operating unit between the back rest and head rest on the body support portion of the frame; and hand grips rotatably mounted on said outer portions of said arms at a spacing from said body support configured to allow manipulation of hand positions without releasing said hand grips when said actuator reverses reciprocation of said arms, each of said hand grips including two axes of rotation via an outer ring rotatably connected to said outer portions of said arms about an axis of said outer ring, and an inner ring with a diametric handle that is rotatable within said outer ring.

2. The reciprocating, dual-directional, negative resistance, exercise machine of claim 1, wherein said rotatable hand grips allow positioning of the hands of the user for exercising the pectoralis major muscles of the user during one direction of reciprocation of said arms and exercising of the latissimus dorsi muscles of the user during the opposite direction of reciprocation of said arms.

3. The reciprocating, dual-directional negative resistance, exercise machine of claim 1, wherein said arms are coplanar.

4. The reciprocating, dual-directional, negative resistance, exercise machine or claim 1, wherein said hand grips are universally rotatably counted on said outer portions of said arms to permit free positioning of said hand grips by gripping hands of a user during exercising use of the machine.

5. The reciprocating, dual-directional, negative resistance, exercise machine of claim 1, characterized further by a load cell mounted between an end of said linearly reciprocating screw piston and the drive rods for sensing the resistive force being applied to said arm by the user during reciprocation of said arm, a computer processing unit mounted on said frame and connected to said load cell for receiving an indication of the sensed resistive force, and having a display panel positioned for observation by a user during exercise, said computer processing unit displaying on said display panel an amount of resistive force being applied by the user.

6. The reciprocating, dual-directional, negative resistance, exercise machine of claim 1, characterized further by a computer processing unit mounted on said frame and operatively connected to said actuator for controlling the rate of reciprocation of said arms during a set of reciprocations in a pattern, selected by the user, of incrementally increasing rates of reciprocation during sequential repetitions of a set of repetitions to simulate a fatigue factor of exercising with free weights.

7. The reciprocating, dual-directional, negative resistance, exercise machine of claim 6, characterized further in that said computer processing unit is programmed for selection by the user of a desired one of a plurality of said patterns having different incrementally increasing rates of reciprocation of said arms.

8. The reciprocating, dual-directional, negative resistance, exercise machine of claim 7, characterized further in that said plurality of patterns includes three patterns, one pattern providing relatively low rates of reciprocation for endurance exercising, a second pattern providing relatively high rates of reciprocation for strength exercising, and the third pattern providing intermediate rates of reciprocation for muscle size exercising.

9. The reciprocating, dual-directional negative resistance, exercise machine of claim 7, characterized further in that said plurality of patterns includes three patterns, one pattern providing relatively low rates of reciprocation for endurance exercising, a second pattern providing relatively high rates of reciprocation for strength exercising, and the third pattern providing intermediate rates of reciprocation for muscle size exercising.

10. The reciprocating, dual directional negative resistance, exercise machine of claim 1, wherein the frame including:

a pair of legs extending outwardly and rearwardly with feet at their outer ends for supporting the machine on a floor;

a central leg extends forwardly with a foot at its forward end for resting on the floor;

the central leg has the body supporting portion that includes an adjustably positioned seat, two spaced back rests, and the headrest;

a foot rest is located on the central leg of the frame adjacent the foot of the central leg; and the central leg and the body support portion mounted on the central leg are inclined and concavely curved for support of a user in a comfortable position for minimized strain during exercise on the machine.

* * * * *